US005164924A

United States Patent [19]

Saito

[11] Patent Number: 5,164,924

[45] Date of Patent: Nov. 17, 1992

[54] DOUBLE-PIPE SWITCH STRUCTURE FOR USE IN COMPACT ELECTRONIC APPARATUS OF WRIST WATCH TYPE

[75] Inventor: Jou Saito, Hamuramachi, Japan

[73] Assignee: Casio Computer Co., Ltd., Tokyo, Japan

[21] Appl. No.: 674,573

[22] Filed: Mar. 25, 1991

[30] Foreign Application Priority Data

Mar. 30, 1990 [JP] Japan ..... 2-32883[U]

[51] Int. Cl.[5] ..... G04B 29/00

[52] U.S. Cl. ..... 368/320; 368/321

[58] Field of Search ..... 368/319-321, 368/327, 306; 354/269

[56] References Cited

U.S. PATENT DOCUMENTS 828,815 8/1906 Edwards ..... 354/269
2,982,194 5/1961 Hannafin ..... 354/269
4,089,156 5/1978 Kashio .
4,184,320 1/1980 Kashio .
4,407,295 11/1983 Steuer et al. .
4,629,329 12/1986 Komiyama .
4,652,141 3/1987 Arai .
4,794,414 12/1988 Kozina et al. ..... 354/269

*Primary Examiner*—Bernard Roskoski
*Attorney, Agent, or Firm*—Frishauf, Holtz, Goodman & Woodward

[57] ABSTRACT

A compact electronic apparatus comprises a casing of a wrist watch shape, a push button switch installed on the casing, waterproof packing being provided between the casing and the push button switch, a metal pipe mounted in the casing with its portion being extending out from the casing and including the push button switch therein, the metal pipe provided with a flange at its extending portion so as to form a recess, which recess is adapted to receive a mounting pipe of a release switch. The construction of the electronic apparatus allows a direct switching operation of the push button switch as well as a switching operation through the release switch. In either events, the casing of the present electronic apparatus is protected from water penetration with an extremely simple construct.

24 Claims, 9 Drawing Sheets

DOUBLE-PIPE SWITCH STRUCTURE FOR USE IN COMPACT ELECTRONIC APPARATUS OF WRIST WATCH TYPE

BACKGROUND OF THE INVENTION

The present invention relates to a compact electronic apparatus of a wrist watch type, which has an electronic circuit within its casing of a wrist watch shape, and on which a member is detachably mounted for controlling operation of the electronic circuit.

PRIOR ART

A wrist watch with a stop watch function is known, which indicates the time as well as has a function as a stop watch for measuring a time period from a starting time to a stop time. In general, the wrist watch with such a stop watch function is provided with a push button switch on its casing for controlling its stop watch operation. On the other hand, a wrist watch is proposed which is provided with a jack connected to the electronic circuits of its stop watch within the casing for receiving a plug, through which an On and/or OFF operation signal of a switch operating member held in hand of a user of the wrist watch is delivered to the electronic circuits.

Meanwhile, a wrist watch is known too, which has a radio receiver function or has a function of exchanging data with an external electronic device. The wrist watch with a radio receiver function is not provided with a speaker within its casing since the speaker needs a large space, resulting in a comparatively large watch in size. Therefore, the wrist watch is provided with a jack in place of the speaker for receiving a plug of an earphone, allowing the user to enjoy radio broadcasting programs through the ear-phone. Similarly, the wrist watch capable of exchanging data with an external device is provided with a jack adapted to receive a plug of the external device for exchanging data.

However, the conventional wrist watch has drawbacks on its construction and is inconvenient for handling. That is, in the wrist watch with its jack receiving a plug so as to be electrically ON/OFF controlled by grasp power of an arm of the user, the plug is pulled out from the jack when the stop watch function is not used. Therefore, the wrist watch has a drawback that the jack is left open, allowing moisture and dust to enter into the casing. Even though the water proof has been made to avoid the above drawback, the wrist watch needs a very complex construction. Furthermore, in case the plug is inserted into the casing for the stop watch operation, there is another drawback that the plug is easily pulled out when the plug is pulled or when an external shock is applied thereto.

SUMMARY OF THE INVENTION

In order to dissolve the above drawbacks, the present invention has been made and its object is to provide a compact waterproof electronic apparatus of a wrist watch type, including a mechanism which is simple in construction and on which an external attachment can be detachably installed but is hard to be removed therefrom.

To achieve the above object, the present invention provides a compact electronic apparatus of a wrist watch type, which comprises a watch casing of a wrist watch shape in which a through hole is formed; a push button switch installed in the through hole of said watch casing through water proof packing; a metal pipe mounted on said watch casing with its extreme end portion extending from said watch casing, involving said push button switch therein and provided with a flange at the portion extending out from said watch casing; and an external operating member comprising an engaging pipe, which is detachably mounted on said metal pipe and engages with the flange of said metal pipe adapted to push said push button switch. The above construction of the electronic apparatus according to the present invention allows water proof for the watch casing without need of a special construction for waterproof. Further, the metal pipe having the flange portion mounted on the watch casing allows an extremely easy installation of the external operating member onto the watch casing. In addition, once the external operating member is mounted on the watch casing, it is very hardly removed from the watch casing. Therefore, the above construction is conveniently used to connect a wrist watch with an external device. Furthermore, because of less number of components incorporated in the apparatus and in view of simplicity of their construction, the apparatus can be fabricated at a comparatively low cost.

BRIEF DESCRIPTION OF THE INVENTION

FIG. 1 is a partial cross-section view of a wrist watch with a stop watch function;

FIG. 2 is a side view of the wrist watch with a stop watch function shown in FIG. 1;

FIG. 3 is a cross-section view showing a release switch member;

FIG. 4 is a side view of the release switch member of FIG. 3;

FIG. 5 is a partial cross-section view of a watch casing with a release switch member urged against the watch casing for mounting;

FIG. 6 is a partial cross-sectional view of the watch casing with the release switch member turned;

FIG. 7 is a cross-section view of a watch casing of the above compact electronic apparatus and a release switch member;

FIG. 8 is a partial cross-section view of the watch casing and the release switch member prepared for mounting on the watch casing;

FIG. 9 is a partial cross-section view of the watch casing with the release switch member pressed against the watch casing for mounting;

FIG. 10 is a partial cross-section view of the watch casing with the release switch member mounted thereon;

FIG. 11 is a partial cross-section view of the watch casing and a release switch member according to the third embodiment;

FIG. 12 is a partial cross-section view of the watch casing of FIG. 11 with the release switch member prepared for engagement;

FIG. 13 is a partial cross-section view of the watch casing of FIG. 11 with the release switch member urged thereto for engagement;

FIG. 14 is a partial cross-section view of the watch casing of FIG. 11 with the release switch member engaged therewith;

DETAILED DESCRIPTION OF THE PREFERRED EMBODIMENTS

Now, the preferred embodiments of the present invention will be described in detail.

FIGS. 1 through 4 are views showing a construction of a compact electronic apparatus embodying the first embodiment of the present invention, which apparatus comprises a wrist watch with a stop watch function and a remote-control switch, i.e., a release switch member.

Figure 1:
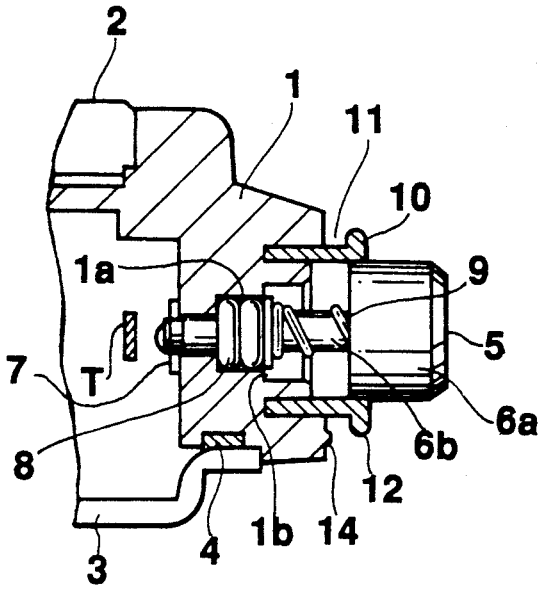
FIGS. 1 through 6 are views showing a construction of a compact electronic apparatus embodying the first embodiment of the present invention, and comprising a wrist watch with a stop watch function and a release switch member.
Figure 2:
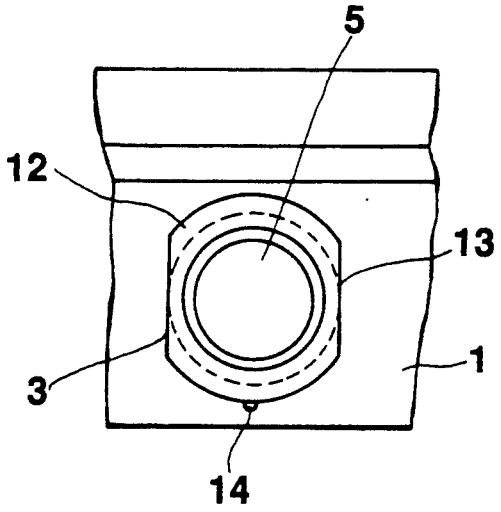

As shown in FIGS. 1 and 2, a watch glass 2 is provided on a front surface of a watch casing 1 of hard synthetic resin (hereafter, simply referred to as "watch casing"). On a rear surface of the watch casing 1 is provided a rear metal cover 3. There is provided waterproof packing 4 between the watch casing 1 and the rear metal cover 3. A module (not shown) of a time counting circuit having a stop watch function is mounted within the watch casing 1. At the side portion of the watch casing 1 is provided a push button switch 5 for controlling START/STOP operation of the time counting circuit in a stop watch mode. The push button switch 5 has a push button 6*a* for a manual manipulation and a button shaft 6*b* integrally connected to a back side of the push button 6*a*. The button shaft 6*b* is inserted through a through hole 1*a* formed in the watch casing 1 and is maintained in the through hole 1*a* with aid of a washer 7 provided inside the watch casing 1. There is also provided waterproof packing 8 wound around the button shaft 6*b* at its middle portion for making waterproof between the button shaft 6*b* and the watch casing 1. Under the influence of a coil spring 9 provided between a ridge 1*b* formed in the through hole 1*a* and the back side of the push button 6*a*, the push button 6*a* is urged all the times to slidably go out of the watch casing 1. Further, there is provided a terminal T inside the watch casing 1, electrically connected to the above mentioned module of the time counting circuit. When the push button 6*a* of the push button switch 5 is depressed, the button shaft 6*b* is advanced to make contact with the terminal T, allowing a switch input signal to be input for START/STOP operation of the stop watch. A bush 10 consisting of a metal pipe is pressed into a groove which is formed in the side portion of the watch casing 1 coaxially with the through hole 1*a*. The push button 6*a* of the push button switch 5 slidably projects outwards from the bush 10. The bush 10 is provided with a flange 12 at its exposed extreme end, and there is formed a recess 11 between the flange 12 of the bush 10 and the side portion of the watch casing 1 for detachably mounting a flexible pipe of the release switch member as will be described later.

As described above, the recess 11 for mounting the flexible pipe of the release switch member is formed by the flange 12 at the exposed extreme end of the bush 10 and the side portion of the watch casing 1. The flange 12 is formed with cutouts 13 symmetrically as shown in FIG. 2 and the side portion of the watch casing 1 has a positioning projection 14 facing the flange 12 of the bush 10.

Figure 3:
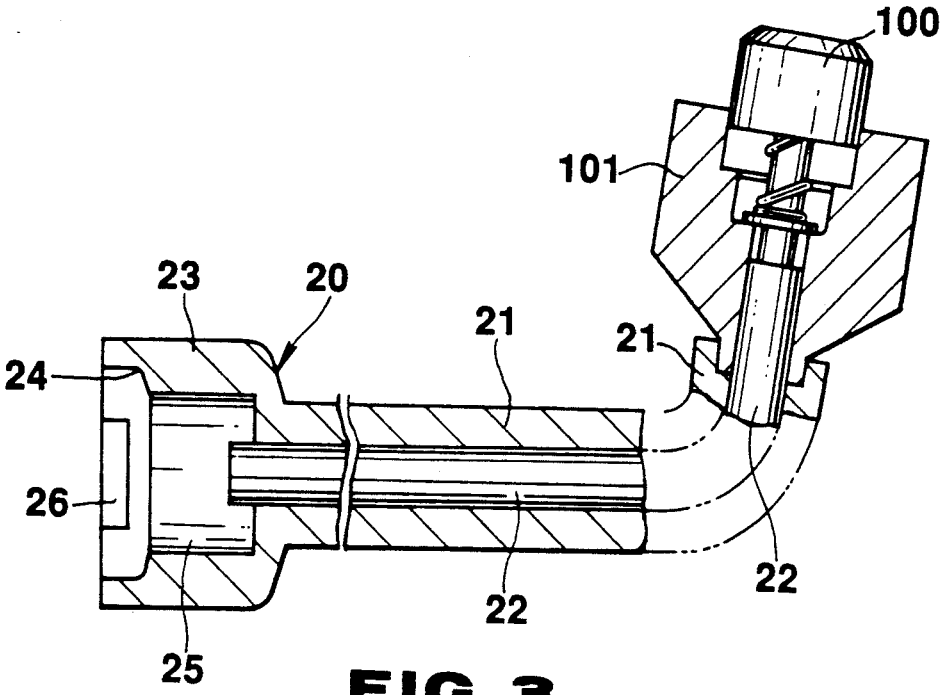
Figure 4:
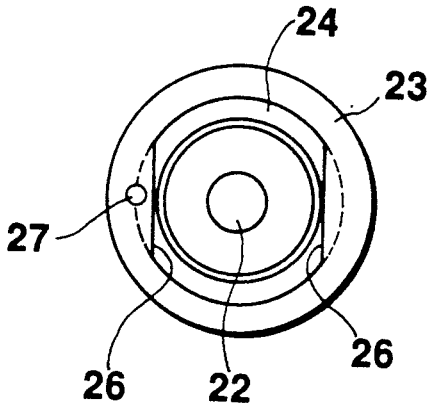
Figure 6:
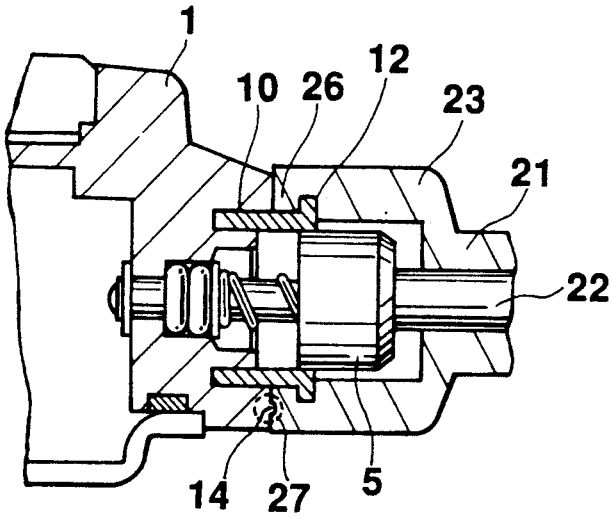

As shown in FIGS. 3 and 4, a release switch 20 is composed of a manually manipulated button 100, a flexible shaft 22 connected to the manually manipulated button 100, a switch case 101 adapted to include the manually manipulated button 100, and a flexible pipe 21 including the flexible shaft 22 one end of which pipe is attached to the switch case 101. The flexible shaft 22 moves sliderably in the flexible pipe 21 when the manually manipulated button 100 is depressed. The other extreme end of the flexible pipe 21 is provided with an engaging pipe section 23. The engaging pipe section 23 involves a hole 25 for receiving the push button switch 5 extending from the metal bush 10 and further forms an enlarged portion 24 in the hole 25 for receiving the flange 12 of the metal bush 10. The enlarged portion 24 of the hole 25 has a pair of engaging projections 26 at its opening end as shown in FIGS. 4 and 6. When the engaging pipe section 23 is put onto the watch casing so as to receive the push button 6*a* of the push button switch 5 with the projections 26 meeting the cutouts 13 of the flange 12 of the bush 10 and then the engaging pipe section 23 is turned, the engaging projections 26 of the engaging pipe section 23 slide within the recess 11 formed by the flange 12 of the bush 10 and the side wall of the watch casing 1, and thereby the flange 12 of the bush 10 shall move within a space surrounded by the enlarged portion 24 and the engaging projections 26 of the engaging pipe portion 23. The engaging pipe section 23 is provided with a recess 27 on its front end close to the engaging projection 26 for engaging with the positioning projection 14 provided on the side wall of the watch casing 1.

In the above wrist watch with a stop watch function, a manually and directly depressing operation of the push button switch 5 allows to control the function of the stop watch for measuring a time. Further, with installation of the release switch member 20 onto the watch casing 1, a manual operation of the manually manipulated button 100 of the switch case 101 held in hand allows to control the stop watch function of the wrist watch in a similar manner.

Installation of the release switch member 20 will be described hereafter.

Figure 5:
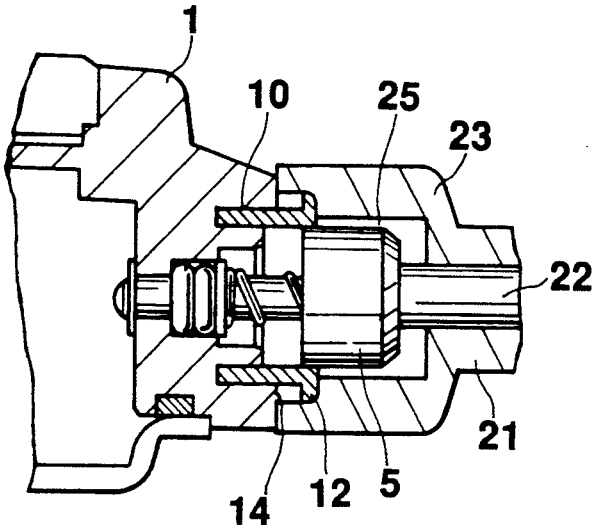

The release switch 20 is urged against the metal bush 10 mounted in the watch casing 1, as shown in FIG. 5, with the engaging projections 26 of the engaging pipe 23 meeting the cutouts 23 of the flange 12 of the metal bush 10. Then, when the engaging pipe 23 is turned, the engaging projections 26 of the engaging pipe 23 slide in the recess 11 formed by the metal bush 10 and the side face of the watch casing 1, and engage with the flange 12 of the metal bush 10, as shown in FIG. 6. In this manner, the release switch member 20 is firmly installed on the watch casing 1 such that the release member 20 is not easily removed from the watch casing 1. The engagement of the positioning projection 14 of the watch casing 1 and the positioning recess 27 formed in the engaging pipe 23 of the release switch member 20 assure positioning of the release switch member 20 and preventing the engaging pipe 23 of the release switch member 20 from turning.

When the engaging pipe 23 is turned to disengage the positioning recess 27 of the engaging pipe 23 from the positioning projection 14 of the watch casing 1 and the engaging pipe 23 is removed from the metal bush 10 with the engaging projections 26 meeting the cutouts 13 of the flange 12 of the metal bush 10, the release switch member 20 can be removed from the watch casing 1.

When the release switch member 20 is installed on the watch casing 1 and the manually manipulated button 100 is depressed, then the flexible shaft 22 connected to the button 100 is advanced and thrust into the hole 25 of the engaging pipe 23 to push the push button 6a of the push button switch 5, and thereby the operation of the stop watch of the electronic apparatus is controlled. Even when the release switch member 20 is removed from the watch casing 1, the operation of the stop watch of the electronic apparatus can be controlled by the direct operation of the push button switch 5. In this case, the construction of the push button switch 5 shall assure waterproof as well as dustproof effects for the watch casing 1.

Now, the electronic apparatus embodying the second embodiment of the invention will be described hereafter. FIGS. 7 to 10 are views showing the main part of the construction of the wrist watch with the stop watch function for installing the release switch member 20. In FIGS. 7 to 10, like reference symbols represent like elements in FIGS. 1 to 4 and a further description thereof will be omitted.

Figure 7:
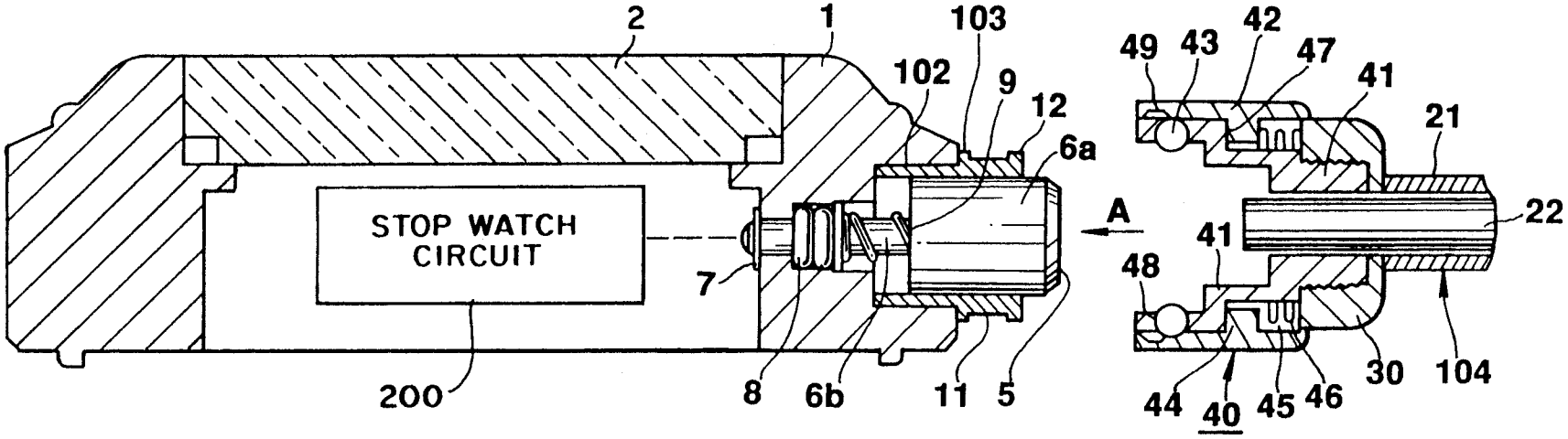
FIGS. 7 through 10 are views showing a construction of a compact electronic apparatus embodying the second embodiment of the present invention.
Figure 8:
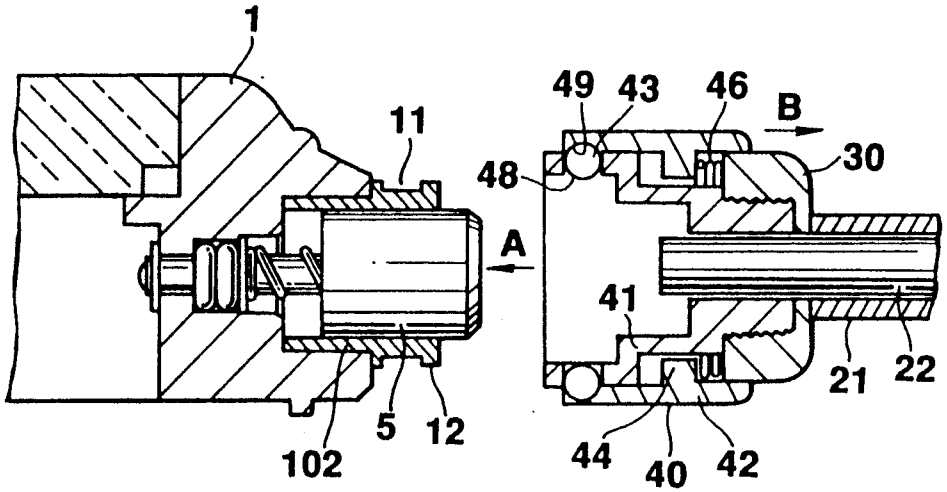
Figure 9:
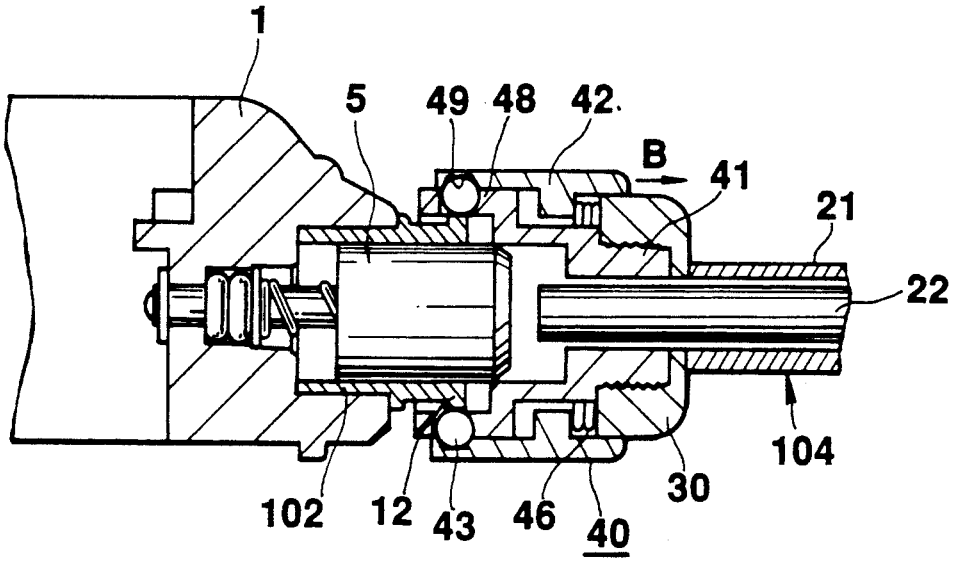

In the wrist watch with the stop watch function, the watch casing 1 is made of metal and is formed with a through hole on its side portion. A watch glass 2 is provided on the front surface of casing 1, as in FIG. 1. A metal bush 102 provided with two flanges 12 and 103. The flange 12 is provided at the extreme end of the metal bush 102 and the other one 103 is at its middle portion, as shown in FIG. 7. The metal bush 102 is pressed into the through hole of the watch casing 1 until the flange 103 meets the side portion of the watch casing. Further, the metal bush is soldered to the watch casing 1. The push button 6a of the push button switch 5 moves slidably in the metal bush 102. The flanges 12 and 103 of the metal bush 102 form an engaging recess 11 therebetween, as shown in FIG. 7. A release switch 104 is mounted on the engaging recess 11 by one touch manipulation.

The release switch 104 has a flexible pipe 21, at the end of which a nut 30 is fixed. An engaging pipe member 40 is threaded onto the nut 30. The engaging pipe member 40 comprises an inner pipe 41 adapted to be threaded onto the nut 30, an outer pipe 42 which moves slidably on an external surface of the inner pipe 41, and two and more balls 43 mounted on the inner pipe for engaging with the engaging recess 11 formed on the bush 102. A circular groove 45 is formed in an outer peripheral surface of the inner pipe 41. An projection 44 provided on an inner surface of the outer pipe 42 which is slidably movable in the circular groove 45 in the direction of the axis of the inner pipe 41 is urged towards the leading wall 47 of the groove 45 under the influence of a coil spring 46 provided in the groove 45. The balls 43 involved in a ball retainer 48 provided in the inner pipe 41 are urged towards the axis of the inner pipe 41 so as to engage with the engaging recess 11 of the metal bush 10. The ball retainer 48 has a construction such that the balls cannot fall away. There is formed a recess 49 in the outer pipe 42 close to its end portion for providing a space for allowing the balls 43 to stay in the ball retainer 48 when the outer pipe 42 is moved against the influence of the coil spring 46.

Figure 10:
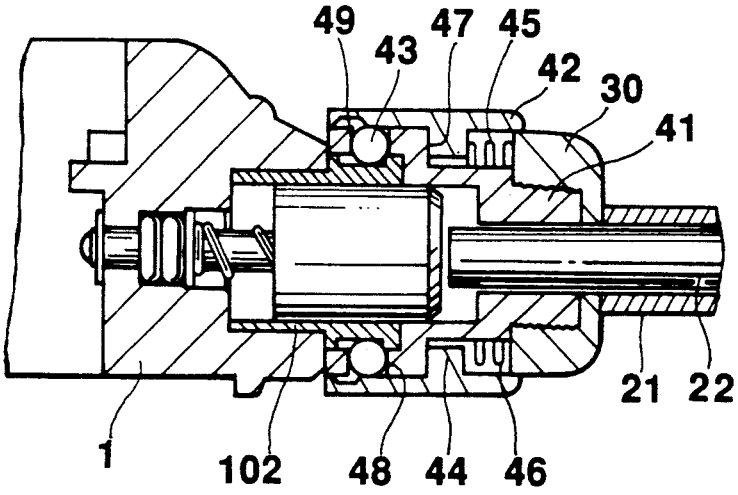

Installation of the remote control switch onto the above wrist watch will be described hereafter. At first, the outer pipe 42 is moved against the influence of the coil spring 46 in the direction shown by an arrow E in FIG. 9, allowing the balls 43 to retire to the recess 49 of the outer pipe 42 from the ball retainer 48 of the inner pipe 41. Then, the engaging pipe member 40 is pressed to the metal bush 102 of the watch casing 1, allowing the balls 43 to move over the flange 12 of the metal bush 102 to the engaging recess 11, and then the outer pipe 42 is released. Then the projection 44 of the outer pipe 42 is urged towards the leading wall 47 of the circular groove 24 under the influence of the coil spring 46 and the balls 43 are moved out from the recess 49 of the outer pipe 42 and held in the engaging recess 11 of the metal bush 102. As a result, the engaging pipe member 40 of the release switch 104 is firmly mounted onto the watch casing 1, as shown in FIG. 10. The engaging pipe member 40 of the release switch 104 can be removed from the watch casing 1 in the opposite manner to the above mentioned.

Similarly to the case of the first embodiment, the release switch 104 can be mounted and removed from the watch casing 1 by one touch manipulation. When a manually operated button (not shown) of the release switch 104 is manipulated, the flexible shaft 22 of the release switch pushes push button switch 5, and thereby the operation of the stop switch to operate the watch circuit 200 (FIG. 7), is remote-controlled. The second embodiment ensures waterproof and dustproof effects to the watch casing 1.

FIGS. 11 through 14 are views showing the third embodiment of the present invention. In the second embodiment shown in FIGS. 7 through 10, the balls 43 are used to make the engaging pipe member 40 of the release switch 104 engaged with the engaging recess 11 of the metal bush 102, but a leaf spring 51 is used in place of the balls 43 in an engaging pipe member 50 according to the third embodiment of the invention. The engaging pipe member 50 comprises a nut 30 fixed to one end of the flexible pipe 21 of the release switch 20, an inner pipe 41 threaded into the nut 30, an outer pipe 42 involving the inner pipe 41 therein and slidably movable on a peripheral surface of the inner pipe 41 and at least a leaf spring, one end 52 of which is fixed on the peripheral surface of the inner pipe 41 and the other end of which extends form the inner pipe 41. At the free end of the leaf spring 51 is provided an engaging projection 53, which is adapted to engage with the engaging recess 11 of the metal bush 102 of the watch casing 1.

Figure 11:
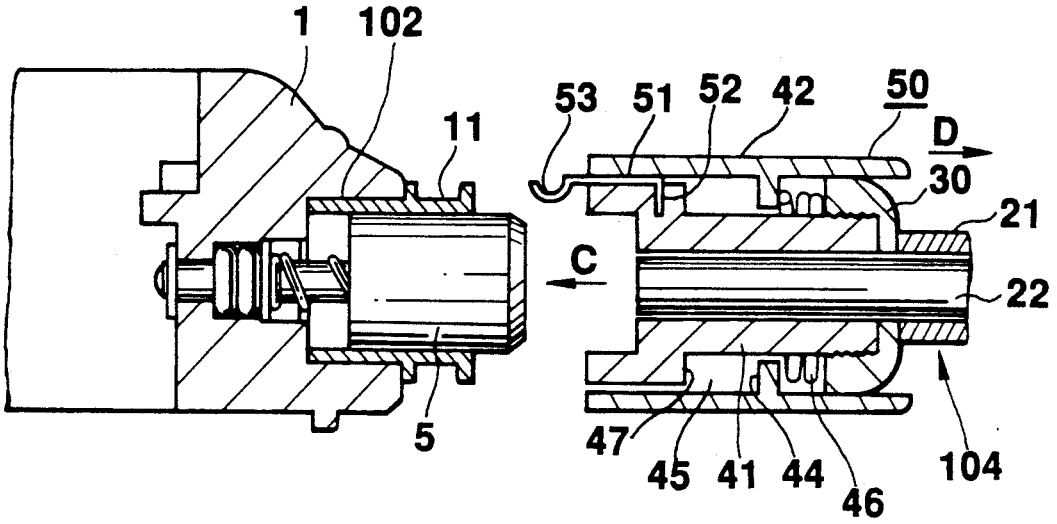
FIGS. 11 through 14 are views showing a construction of a compact electronic apparatus embodying the third embodiment of the present invention, which embodiment uses a leaf spring.
Figure 12:
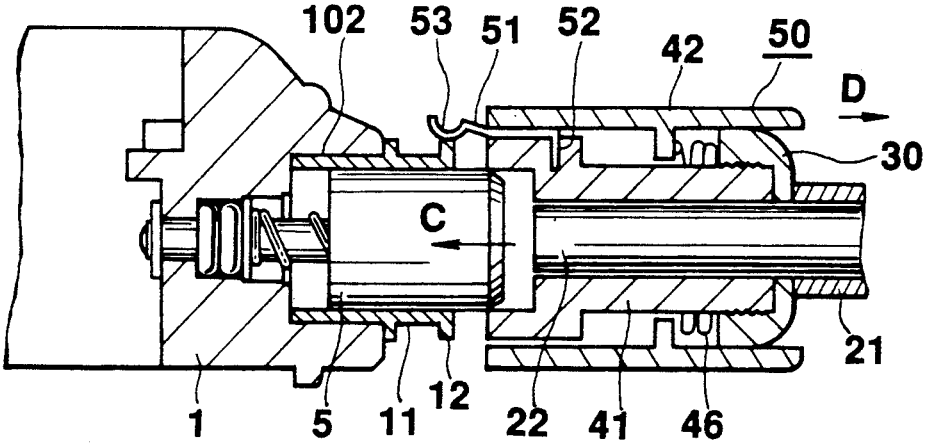
Figure 13:
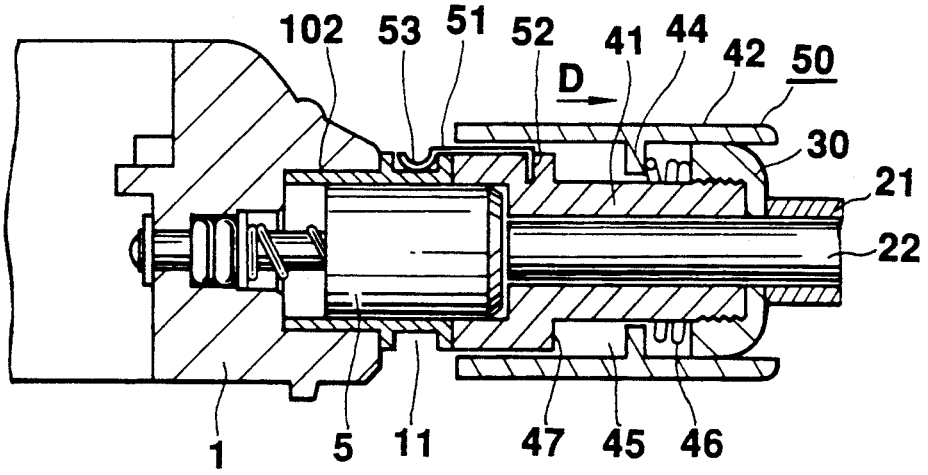
Figure 14:
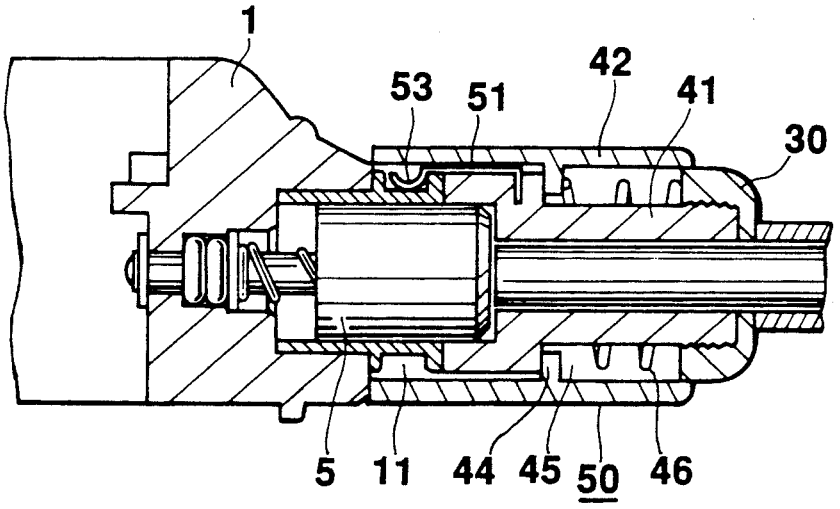

For installation of the remote control switch, the engaging pipe member 50 of the release switch 104 is pressed in the direction shown by an arrow C onto the metal bush 102 of the watch casing 1, as shown in FIG. 11. In the course of the installation, the outer pipe 42 is forced to retire against the influence of the coil spring 46 in the direction shown by an arrow D in FIG. 12, allowing the engaging projection 53 of the free end of the leaf spring 51 to go over the flange 12 of the metal bush 10. When the engaging projection 53 of the leaf spring 46 engages with the engaging recess 11 of the metal bush 10 and the outer pipe 42 is released, the outer pipe is advanced under the influence of the coil spring 46, holding the leaf spring 51. As the result, as shown in FIG. 14, the engaging projection 53 of the leaf spring 51 engages firmly with the engaging recess 11 of the metal bush 10.

As described above, similarly to the first and second embodiments of the invention, the third embodiment allows an easy installation of the remote control switch onto the watch casing and ensures waterproof and dust-proof effects.

Figure 15:
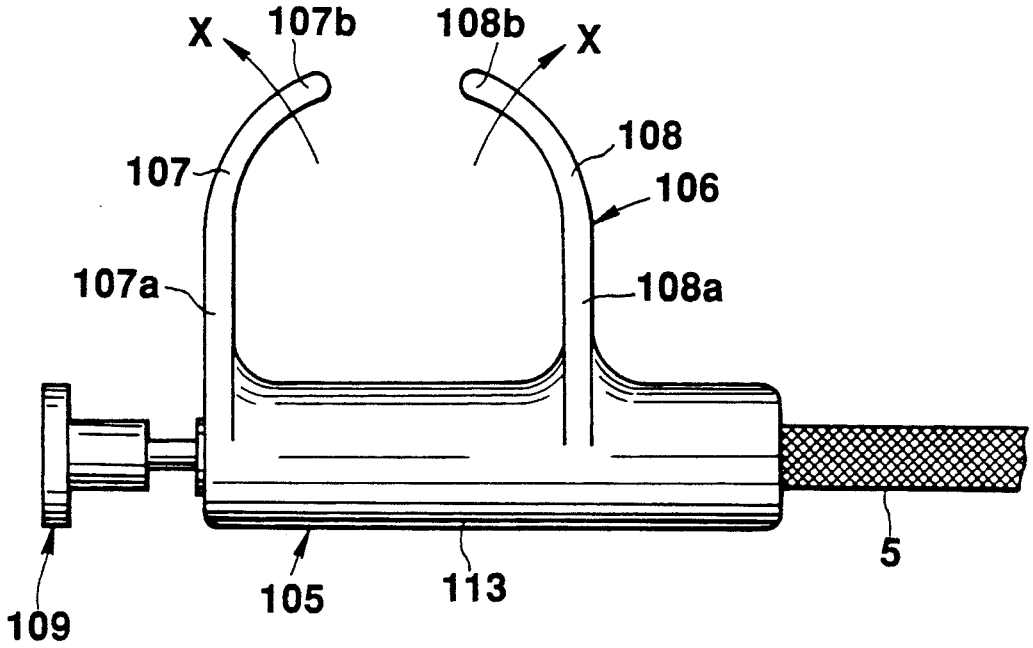
FIG. 15 is a front view showing a main part of the release device used in the embodiment of the invention.

FIG. 15 is a view of another embodiment of the invention, showing a grip of the release switch.

In FIG. 15, the pipe 113 of the grip 105 of the release switch is made from elastic synthetic resin such as polyamide resin. The resin pipe 113 has a trigger portion 106. The trigger portion 106 consists of a pair of elastic triggers 107, 108, which are facing to each other and combined in unit with the resin pipe 113. The pair of elastic triggers 107, 108 have the width substantially equal to a length of the diameter of the resin pipe 113. The elastic triggers 107, 108 extend from the resin pipe 113 in parallel at right angles to the axis of the resin pipe 113. The free end portions 107*b*, 108*b* of the triggers 107, 108 are bent so as to gradually come closer to each other. That is, the pair of elastic triggers 107, 108 form a space for allowing the middle finger on the left hand of a user to be inserted therein and the bent portions 107*b*, 108*b* of the triggers 107, 108 serves to hold the middle finger firmly.

When a middle finger of the user of the release device is inserted into the triggering portion 106 consisting of a pair of triggers 107, 108, the triggering portion 106 shall be hold by the inserted middle finger. Therefore, the user can hold the grip 105 steadily by inserting his left-hand middle finger into the triggering portion 106 and grasping the resin pipe 113 with other left-hand fingers and can push the release button 109 with his left-hand thumb.

When the release switch catches somewhere and is pulled by something, the left-hand middle finger inserted into the triggering portion 106 is also pulled by something. At this time, the elastic triggers 107, 108 of the triggering portion 106 holding the middle finger 143 deformed in the directions shown by arrows X, X in FIG. 15, releasing the middle finger from the triggering portion 106. Therefore, the middle finger is safely protected against an unexpected external force and also the connecting portion of the wrist watch and the release device can avoid damage.

Figure 17:
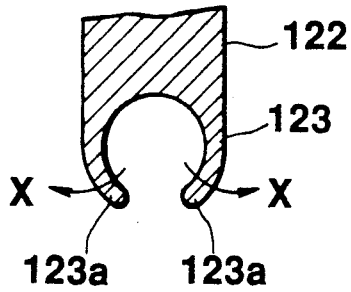
FIG. 17 is a cross-section view showing the release device of FIG. 16 taken along line Y—Y.
Figure 16:
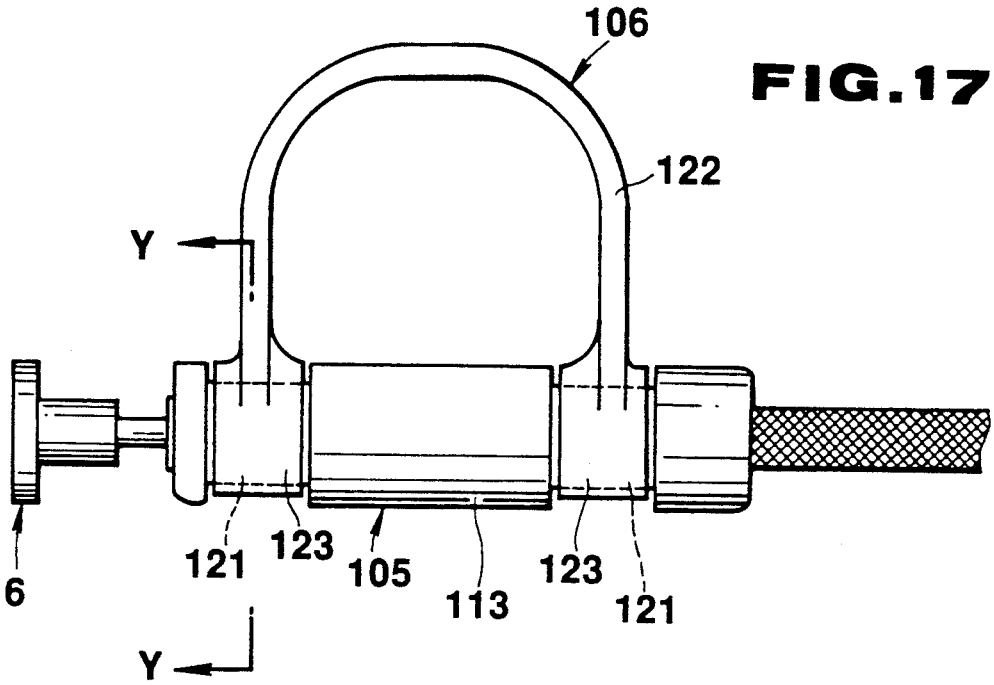
FIG. 16 is a front view showing a main part of the release device used in other embodiment of the invention.

FIGS. 16 and 17 are views showing other embodiment of the invention. In FIGS. 16 and 17, like reference symbols represent like elements of the embodiment of FIG. 15 and a further description thereof will be omitted.

The resin pipe 113 of the triggering portion 105 is formed with two portions 121 of a small diameter at its predetermined positions. A triggering portion 106 is a separate body from the resin pipe 113 and made of elastic synthetic resign such as polyamide. The triggering portion 106 is made of a U-shaped resin plate 122 having a width substantially equal to a value of the diameter of the resin pipe 113. The U-shaped resin plate 122 has elastic engaging portions 123, 123 at both its extreme ends. These engaging portions 123 are of a C-shape and have a pair of elastic engaging pieces 123*a*, 123*a* as shown in FIG. 17. The pair of elastic engaging pieces 123*a*, 123*a* are widen in the directions shown by arrows X, X as shown in FIG. 17 and are allowed to clutch the small diameter portion 123 of the resin pipe 113. Therefore, the triggering portion 106 can be detachably mounted on the resin pipe 113.

When the apparatus catches somewhere and is pulled by something, the left middle finger inserted into the triggering portion 106 is also pulled by something. But at this time, the pair of elastic engaging pieces 123*a* of the triggering portion 106 holding the middle finger are deformed in the directions shown by arrows X, X in FIG. 17, allowing the triggering portion 106 to leave from the resin pipe 113. Therefore, the middle finger is safely protected against an unexpected external force and also the connecting portion of the wrist watch and the release device can avoid damage.

Figure 18:
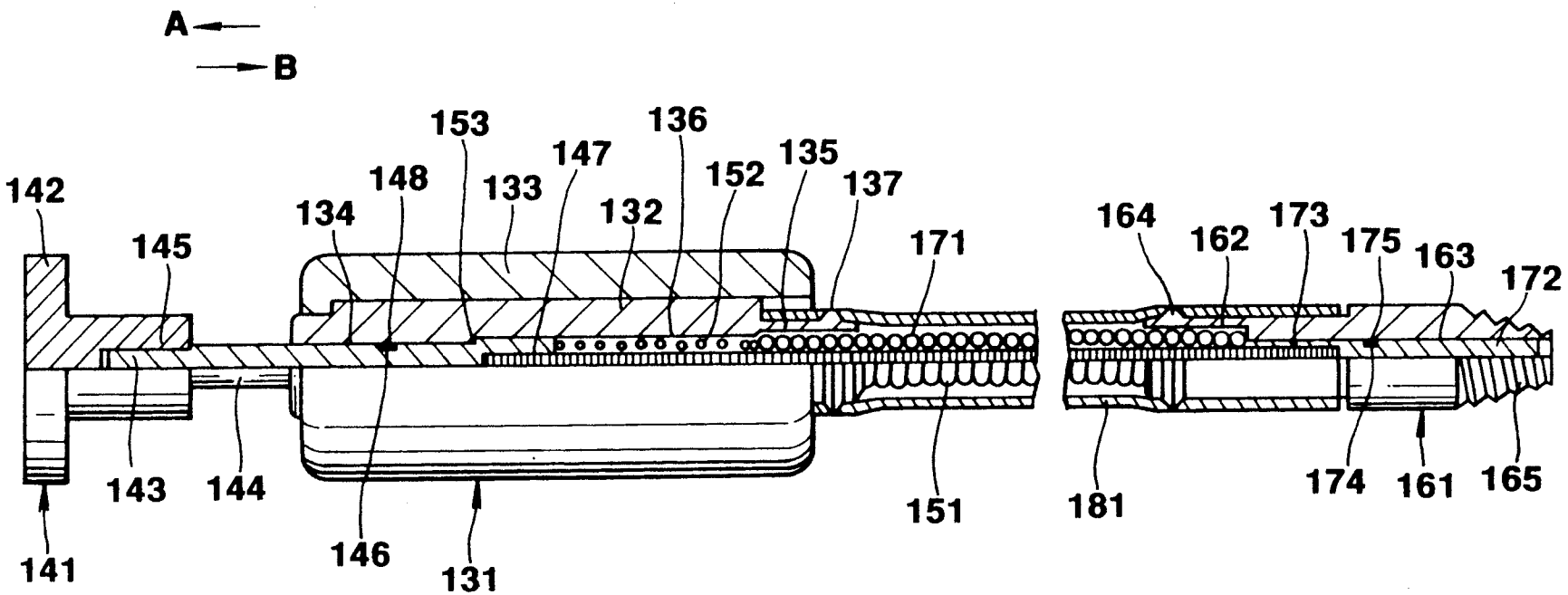
FIG. 18 is a partial cross-section view showing a release device according to another embodiment.

FIG. 18 is a partial cross-section view showing yet another embodiment of the present invention, which is arranged to make waterproof to a release switch device.

The release switch device is provided with a tubular grip member 131. The tubular grip 131 is composed of a metal pipe 132 covered with resin pipe 133. The metal pipe 132 is formed with a through hole 136 at its center. The through hole 136 has a small diameter at its one extreme end (at its left end as viewed in FIG. 18), a medium diameter at its middle portion and a large diameter at its opposite end (at the right end as viewed in FIG. 18). The metal pipe 132 has a small diameter portion at its one end. A circular projection 137 is formed as a stopper, around the external peripheral surface of the outermost end of the small diameter portion.

A release button 141 is mounted on the extreme end of the metal pipe 132. The release button 141 with a tapped hole 143 formed in a button portion 142 is secured to a tapped portion 145 formed on one end of a button shaft 144. The button shaft 144 is formed with a circular groove 146 at a certain position on its external peripheral surface. A portion of the button shaft 144 close to the other end is of a large diameter, where an engaging hole 147 is formed at its center along the longitudinal direction of the button shaft 144. There is provided a packing O-ring 148 in the groove 146 of the button shaft 144 for making waterproof between the button shaft 144 and the internal peripheral surface of the small diameter portion 134 of the metal pipe 132. The button shaft 144 is slidably moved inside the metal pipe 132 in the direction shown by arrows A and B in FIG. 18.

One end of an external coil spring 151 is held in the large diameter portion 135 of the through hole of the metal pipe 132, which spring 151 is employed to connect the grip member 131 with a connecting member 161 as described later. There is provided a return coil-spring 152 in the middle diameter portion 136 of the through hole of the metal pipe 132 and between the extreme end of the button shaft 144 and the end of the external coil-spring 151. The button shaft 144 is urged in the direction shown by the arrow A under the influence of the return coil-spring 152 and as a result the edge 153 of the large diameter portion of the button shaft 144 is abutted at all times to the ridge 154 formed between the small diameter hole 134 and the middle diameter hole 136 of the metal pipe 132, preventing the button shaft 144 from being drew out and allowing it to be positioned at an initial location.

To the other end portion of the external coil-spring 151 is fixed the connecting member 161. The connecting member 161 is formed, at its center, with a through hole having a large diameter 162 at a portion close to one end and a small diameter 163 at another portion. The connecting member 161 is also provided with a circular projection 164 around the external peripheral surface close to its one end for preventing from being drew out. The connecting member 161 has a tapped portion 165 at the other end, to which the engaging member 50 to 49 of FIG. 7 is connected. The connecting member 161 is fixed to one end of the external coil-spring 151, with the large diameter hole 162 of the connecting member 161 abutted to the end of the external coil-spring 151.

Inside the external coil-spring 151 there is inserted an internal coil-spring 171 movable in the directions shown by arrows A and B in FIG. 18. One end of the internal coil-spring 171 is engaged with the engaging hole 147 of the button shaft 144 through the return coil-spring 152. The other end of the internal coil-spring 171 is engaged with an engaging hole 173, which is formed in one end of a pushing pin 172. The pushing pin 172 is formed with a circular groove 174 at a predetermined position on its external peripheral surface. An O-ring 175 is received in the circular groove 174 for making waterproof between the small diameter hole 173 of the engaging member 174 and the pushing pin 172.

The external coil-spring 151 is covered with a resin pipe 181, which is appropriately shrunk with heat. One end portion of the resin pipe 181 is also shrunk with heat to cover the external surface of end portion of the metal pipe 132 including the circular projection 137. The other end portion of the resin pipe 181 is shrunk with heat too, to cover the external surface of one end portion of the connecting member 161 including the circular projection 164. As described above, both the end portions of the resin pipe 181 properly bite the circular projection 137 of the metal pipe 132 and the projection 164 of the connecting member 161, so that both the ends of the resin pipe 181 are firmly fixed onto the external surfaces of the metal pipe 132 and the connecting member 161, respectively.

The release switch device constructed as described above functions as follows. When the user of the release switch device pushes the button portion 142 of the release button 141, the button shaft 144 is moved in the direction shown by the arrow B in FIG. 181 against the influence of the return coil-spring 152, causing the internal coil-spring 171 to move in the same direction shown by the arrow B. Then the pushing pin 172 extends out from the tapped portion 165 of the connecting member 161, pushing the switch 5 of the wrist watch of FIG. 1. When the button portion 142 of the release button 141 is released, the button shaft 144 moves in the direction shown by the arrow A under the influence of the return coil-spring 152, allowing the internal coil-spring 171 and the pushing pin 172 to return to their initial positions.

In the release switch device, the external surface of one end of the metal pipe including the circular projection 137, the external coil-spring 151 and the external surface of the connecting member 161 including the circular projection 164 are covered with the resin pipe 181, which is shrunk with heat. Further, a connecting portion of the resin pipe 181 and metal pipe 132 as well as a connecting portion of the resin pipe 181 and the connecting member 161 are made waterproof. Therefore, the user of the release switch device is allowed to use it in the rain or on the seaside without worrying about protecting the external coil-spring 151, the internal coil-spring 171 and the return coil-spring 152 from being stained with water. In addition, since the resin pipe 181 is shrunk with heat so as to bite the projections of the metal pipe 132 and the connecting member 161, no special connecting device is required, resulting in a simple construction.

The release switch device employs the O-rings 148 and 175 on the button shaft 144 of the release button 141 and the pushing pin 172, improving further a waterproof function.

The above embodiments of the present invention have been described, which are applied to a wrist watch with a stop watch function to control its start/stop operation. But these embodiments can be used with a casing of a wrist watch type including a stop-watch function only. Further, the embodiments are not limited to a switch for controlling the start/stop operation of a stop watch but can be used as a switch for controlling various functions in other apparatus. Furthermore, if the push button switch 5 and the button shaft 5 are made of a conductive material and the flexible shaft 22 is also made of a conductive material, and further the push button is kept at all times in contact with the terminal T as shown in FIG. 1, an ON/OFF electric signal at an external operator is allowed to be transferred directly to an electronic circuit in the watch casing 1. Similarly, the apparatus according to the present invention can be used as a connecting terminal for communication between the electronic circuit in the watch casing 1 and other electronic apparatus.

What is claimed is:

1. A compact electronic apparatus of a wrist watch type, comprising:

a casing of a wrist-watch shape formed with a through hole therein;

a push button switch disposed in the through hole formed in said casing, waterproof packing being provided between said push button switch and the through hole of said casing;

a metal pipe mounted in said casing with a portion of said metal pipe extending out from said casing, said metal pipe having a flange portion at the end of the portion thereof extending out from said casing, said metal pipe including said push button switch therein; and an externally operable member detachably mounted on said metal pipe, said externally operable member having:

an internal pipe member provided with an engaging member adapted to be engaged with the flange portion of said metal pipe, an external pipe member for preventing the engaging member of the internal pipe member from being disengaged from the flange portion of said metal pipe, and a shaft member disposed in the internal pipe member for pushing said push button switch to operate said push button switch.

2. A compact electronic apparatus of a wrist watch type according to claim 1, wherein said casing includes an electronic circuit controlled by a switch input of said push button switch.

3. A compact electronic apparatus of a wrist watch type according to claim 2, wherein said electronic circuit comprises a stop watch circuit, which is controlled by the switch input of said push button switch so as to start a time measuring operation.

4. A compact electronic apparatus of a wrist watch type according to claim 1, wherein said metal pipe is a round metal pipe and has a second flange portion abutting against a side wall of said casing, said second flange portion being spaced from the first-mentioned flange portion so as to form a groove therebetween, the engaging member of the internal pipe member of said externally operable member being engaged in said groove.

5. A compact electronic apparatus of a wrist watch type according to claim 1, wherein:

the internal pipe member of said externally operable member is of a larger diameter than that of the flange portion, and is provided with said engaging member in its inside, and said external pipe member is slidably and coaxially mounted on the internal pipe member so as to include the internal pipe member therein, and is provided at its internal surface with a recess portion adapted to receive a part of the engaging member of the internal pipe member, and the flange portion of said metal pipe is inserted into the internal pipe member with a part of the engaging member received in the recess portion of said external pipe member and then the external pipe member is slidably movable on the internal pipe member towards said casing, thereby causing the engaging member to come out from the recess portion of said external pipe member so as to engage with the flange portion of said metal pipe.

6. A compact electronic apparatus of a wrist watch type according to claim 5, further comprising:

an elastic urging member for urging said external pipe member so as to retain the engaging member of said internal pipe member out of the recess portion of said external pipe member.

7. A compact electronic apparatus of a wrist watch type according to claim 1, wherein said engaging member of the internal pipe member comprises a ball shaped member.

8. A compact electronic apparatus of a wrist watch type according to claim 1, wherein the flange portion of said metal pipe comprises a pair of spaced apart flanges which form an engaging recess therebetween, said engaging recess being adapted to receive a part of the engaging member extending into inside of the internal pipe member.

9. A compact electronic apparatus of a wrist watch type according to claim 1, wherein the shaft member of said externally operable member is flexible.

10. A compact electronic apparatus of a wrist watch type according to claim 1, wherein said casing is formed of a hard synthetic resin and said metal pipe is buried into said casing except for the extending portion thereof.

11. A compact electronic apparatus of a wrist watch type according to claim 1, wherein said metal pipe is of an angular configuration in its cross section and the flange portion of said metal pipe is formed into a similar angular configuration and the internal pipe member of said externally operable pipe is also formed into the similar angular configuration so as to receive the angular flange portion of said metal pipe.

12. A compact electronic apparatus of a wrist watch type according to claim 1, wherein said casing and the internal pipe member of said externally operable switch are provided with positioning portions, respectively.

13. A compact electronic apparatus of a wrist watch type, comprising:

a casing of a wrist-watch shape formed with a through hole therein;

a push button switch disposed in the through hole formed in said casing, waterproof packing being provided between said push button switch and the through hole of said casing;

a metal pipe, comprising a round tube portion, mounted in said casing with a portion of said round tube portion extending out from said casing, said metal pipe having a flange portion at the end of the portion thereof extending out from said casing, said metal pipe including said push button switch therein; and an externally operable member comprising:

an operating portion at one end thereof which is adapted to be depressed with a finger of a user, an internal pipe member which is provided with an engaging member adapted to be engaged with the flange portion of said metal pipe, an external pipe member which is coaxially mounted on said internal pipe member so as to include said internal pipe member therein for preventing said engaging member of said internal pipe member from being disengaged from the flange portion of said metal pipe, and a shaft member extending from one end to another end of said externally operable member, which urges said push button switch when the operating portion is depressed by a user.

14. A compact electronic apparatus of a wrist watch type according to claim 13, wherein:

the internal pipe member of said externally operable member is of a larger diameter than that of the flange portion, and is provided with said engaging member in its inside, and said external pipe member is slidably and coaxially mounted on the internal pipe member so as to include the internal pipe member therein and is provided at its internal surface with a recess portion adapted to receive a part of the engaging member of the internal pipe member, and the flange portion of said metal pipe is inserted into the internal pipe member with a part of the engaging member received in the recess portion of said external pipe member and then the external pipe member is slidably movable on the internal pipe member towards said casing, thereby causing the engaging member to come out from the recess portion of said external pipe member so as to engage with the flange portion of said metal pipe.

15. A compact electronic apparatus of a wrist watch type according to claim 14, wherein said engaging member comprises a ball.

16. A compact electronic apparatus of a wrist watch type according to claim 14, further comprising;

an elastic urging member for holding said external pipe member such that the engaging member pipe is held to stay outside the recess portion of said external pipe member.

17. A compact electronic apparatus of a wrist watch type according to claim 14, wherein the flange portion of said metal pipe is formed with an engaging recess between a pair of flanges, and the engaging member projecting from said internal pipe member engages with the engaging recess of said metal pipe.

18. A compact electronic apparatus of a wrist watch type according to claim 15, wherein the shaft member of said externally operable member is made of a flexible material.

19. A compact electronic apparatus of a wrist watch type according to claim 10, wherein said casing includes an electronic circuit controlled by a switch input of said push button switch.

20. A compact electronic apparatus of a wrist watch type according to claim 10, wherein said electronic circuit is a stop watch circuit, which is controlled by the switch input of said push button switch so as to start a time measuring operation.

21. A compact electronic apparatus of a wrist watch type according to claim 13, wherein said externally operable member is provided with waterproof packing between the operating portion and the shaft member, and between the engaging member and the shaft member, respectively.

22. A compact electronic apparatus of a wrist watch type according to claim 13, wherein said casing is formed of a hard synthetic resin and said metal pipe is buried into said casing except for the extending portion thereof.

23. A compact electronic apparatus of a wrist watch type according to claim 13, wherein the operating portion of said externally operable member is formed with a trigger portion.

24. A compact electronic apparatus of a wrist watch type according to claim 13, wherein the shaft member of said externally operable member is covered with a resin pipe, which is shrunk with heat.

* * * * *